US006324367B1

(12) United States Patent
Ateya et al.

(10) Patent No.: US 6,324,367 B1
(45) Date of Patent: Nov. 27, 2001

(54) REVERSIBLE PUMP AND SYSTEM FOR SUPPLYING DEVELOPER IN A LIQUID ELECTROPHOTOGRAPHIC PRINTER USING THE SAME

(75) Inventors: Antoun I. Ateya, Pittsford, NY (US); Jung-woo Kim, Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/399,748

(22) Filed: Sep. 20, 1999

(30) Foreign Application Priority Data

Sep. 19, 1998 (KR) ..... 98-38826

(51) Int. Cl.[7] ..... G03G 15/10
(52) U.S. Cl. ..... 399/237; 399/246
(58) Field of Search ..... 399/237, 238, 399/246, 247, 248; 396/564, 626, 633, 627, 582

(56) References Cited

U.S. PATENT DOCUMENTS 4,350,429 * 9/1982 Slavin .
4,605,297 * 8/1986 Livingston .
5,918,093 * 6/1999 Kim ..... 399/237
5,970,289 * 10/1999 Yoo ..... 399/237
5,999,778 * 12/1999 Chang et al. ..... 399/237
6,011,943 * 1/2000 Kim ..... 399/238

* cited by examiner

*Primary Examiner*—William J. Royer
(74) *Attorney, Agent, or Firm*—Sughrue, Mion, Zinn, Macpeak & Seas, PLLC

(57) ABSTRACT

A reversible pump including a case having an intake through which fluid is taken in, a first outlet for discharging internal fluid to the outside, and a second outlet for discharging internal fluid to the outside, an impeller rotatably installed within the case which is capable of rotating in normal and reverse directions, the impeller having a plurality of blades the right and left sides of which are symmetrical to each other in the radial direction of the impeller so that the rotational loads in both the forward and reverse directions are substantially the same, and a motor for rotating the impeller, wherein the fluid is discharged to either the first or second outlet according to the rotating direction of the impeller.

1 Claim, 5 Drawing Sheets

REVERSIBLE PUMP AND SYSTEM FOR SUPPLYING DEVELOPER IN A LIQUID ELECTROPHOTOGRAPHIC PRINTER USING THE SAME

BACKGROUND OF THE INVENTION

1. Field of the Invention

The present invention relates to a reversible pump having an improved structure such that intake fluid is selectively discharged in two directions, and a system for supplying developer in a liquid electrophotographic printer using the same.

2. Description of the Related Art

In general, liquid electrophotographic printers print desired images by developing electrostatic latent images, formed on a photoreceptor medium such as a photoreceptor belt, using a developer of a predetermined color and transcribing the resultant images on paper.

As shown in FIG. 1, the liquid electrophotographic printer is comprised of a developing unit 20 for supplying a developer to a photoreceptor belt 10 and developing the photoreceptor belt 10, and a developer supply system for continuously supplying a developer of a predetermined concentration to the developing unit 20.

The developer supply system includes a developer tank 30 for containing a developer of a concentration suitable for developing, a spray nozzle 60 for supplying the developer to the photoreceptor belt 10 and the developing unit 20, and a supply pump 40 for pumping the developer from the developer tank 30 to the spray nozzle 60. The developer contained in the developer tank 30 is a diluted solution where concentrated ink including powder toner and liquid carrier are mixed in a predetermined ratio. Thus, in order to prevent the concentration of the developer from becoming non-uniform since the toner settles at the bottom of the developer tank 30, a valve 50 is installed between the supply pump 40 and the spray nozzle 60 in the developer supplying system to return the developer to the developer tank 30 and agitate the developer within the developer tank 30. That is, the valve 50 operates so that the developer contained in the developer tank 30 is pumped by the supply pump 40 and supplied to the developing unit 20 via the spray nozzle 60, and that the developer pumped by the supply pump 40 returns to the developer tank 30 in a standby state after the developing operation is completed.

As shown in FIGS. 2 and 3, the supply pump 40 includes an impeller 41 rotatably installed within a case 45 having an intake 42 and an outlet 43, a motor 44 for rotating the impeller 41, and a plurality of blades 41 a installed on the impeller 41. In the supply pump 40 having this general structure, fluid taken in through the intake 42 is discharged through the outlet 43 as the impeller 41 rotates in the direction indicated by an arrow.

However, the conventional supply pump 40 can perform only two operations such as discharge or suspension of fluid according to the driving of the motor 44. Thus, an expensive valve 50 must be installed as described above to supply the developer within the developer tank 30 to the developing unit 20 or return the same to the developer tank 30. Accordingly, in a printer for realizing a plurality of colors such as a color laser printer, a valve must be installed for the developing unit of each color, thereby increasing the number of component parts to be managed. Therefore, a pump having a structure which can realize a plurality of fluid discharging paths without adopting an expensive valve is required.

SUMMARY OF THE INVENTION

To solve the above problem, it is an object of the present invention to provide a reversible pump having an improved structure such that a plurality of fluid discharging paths are realized by the pump itself, and a system for supplying a developer in a liquid electrophotographic printer using the same.

To achieve the above object, the present invention provides a reversible pump comprising: a case having an intake through which fluid is taken in, a first outlet for discharging internal fluid to the outside, and a second outlet for discharging internal fluid to the outside; an impeller rotatably installed within the case which is capable of rotating in normal and reverse directions, the impeller having a plurality of blades the right and left sides of which are symmetrical to each other in the radial direction of the impeller so that the rotational loads in both the forward and reverse directions are substantially the same; and a motor for rotating the impeller, wherein the fluid is discharged to either the first or second outlet according to the rotating direction of the impeller.

To achieve the above object, the present invention provides a developer supply system in a liquid electrophotographic printer, the system comprising: a developer tank for containing the developer; a spray nozzle for supplying the developer to the developing unit and photoreceptor belt therein; and a reversible pump including a case having an intake through which fluid is taken in from the developer tank, a first outlet for discharging the developer to the spray nozzle, and a second outlet for discharging the developer to the developer tank, an impeller rotatably installed within the case which is capable of rotating in normal and reverse directions, the impeller having a plurality of blades the right and left sides of each are symmetrical to each other in the radial direction of the impeller so that the rotational loads in both the forward and reverse directions are substantially the same, and a motor for rotating the impeller.

BRIEF DESCRIPTION OF THE DRAWINGS

The above object and advantage of the present invention will become more apparent by describing in detail a preferred embodiment thereof with reference to the attached drawings in which.

DESCRIPTION OF THE PREFERRED EMBODIMENT

Figure 4:
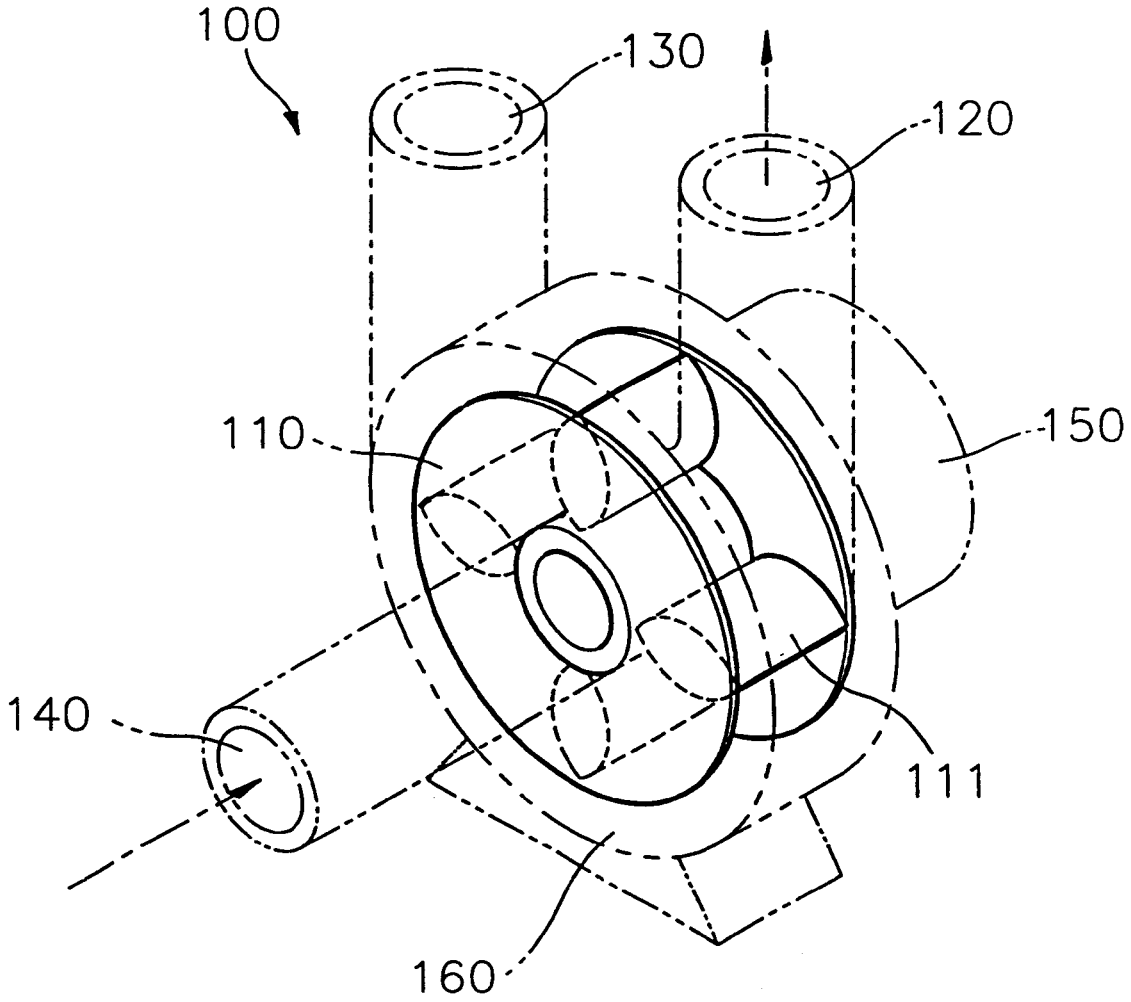
FIG. 4 schematically illustrates a reversible pump according to a preferred embodiment of the present invention.

As shown in FIG. 4, a reversible pump 100 according to a preferred embodiment of the present invention is comprised of a case 160 provided with an intake 140 and first and second outlets 120 and 130, an impeller 110 rotatably installed within the case 160, and a motor 150 for driving the rotation of the impeller 110. A plurality of blades 111, the left and right sides of which are symmetrical to each other in the radial direction of the impeller 110, are installed on the impeller 110, so that rotational loads in the normal and reverse directions are the same. That is, the right and left surfaces of the blades 111 are symmetrical to each other.

Figure 5:
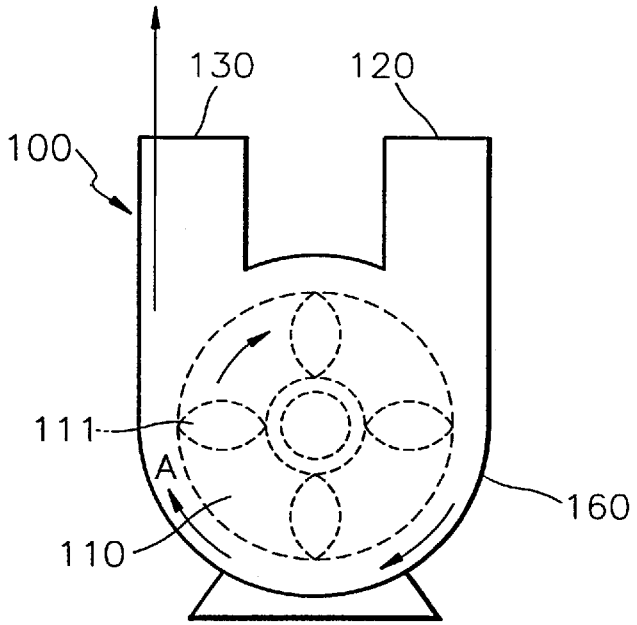
FIGS. 5 and 6 are views for explaining the operation of the reversible pump of FIG. 4.
Figure 6:
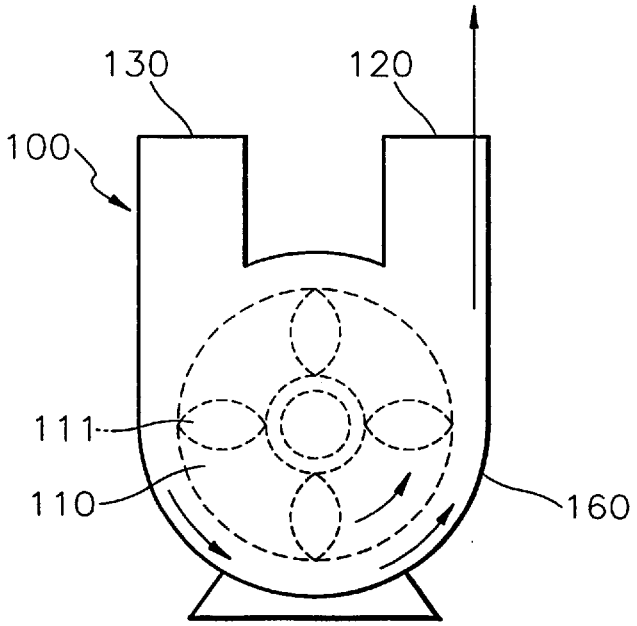

As shown in FIG. 5, when the impeller 110 rotates clockwise, fluid taken in by the intake 140 flows in the direction, indicated by arrow A, impelled by the blades 111 and is discharged via the second outlet 130. At this time, since the first outlet 120 is installed such that fluid flows in a direction reverse to the rotating direction of the fluid, fluid does not flow through the first outlet 120. As shown in FIG. 6, when the impeller 110 rotates counterclockwise, fluid is discharged not from the second outlet 130 but from the first outlet 120. That is, the reversible pump 100 discharges fluid to either the first or second outlets 120 or 130 according to the rotating direction of the impeller 110.

Figure 1:
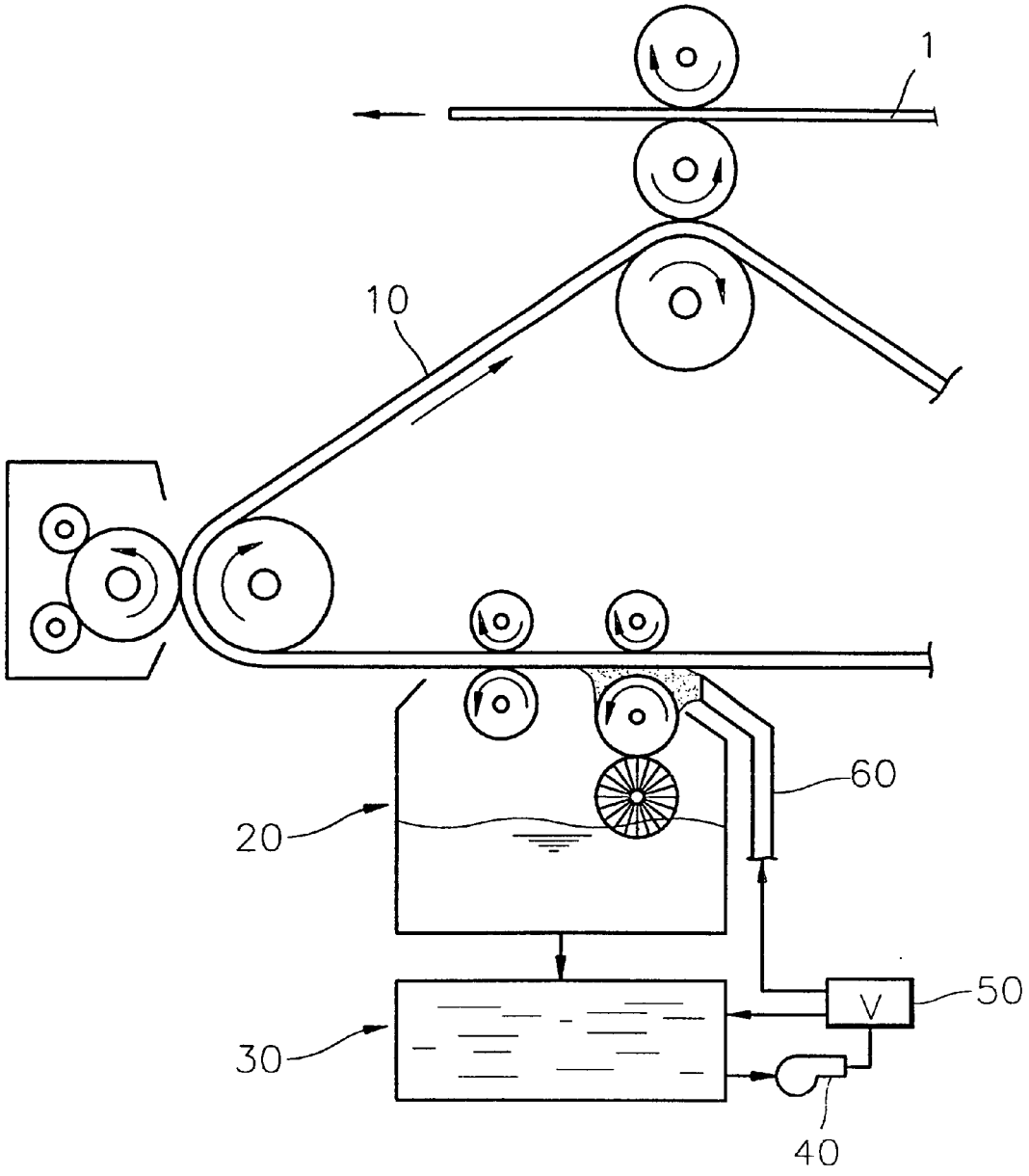
FIG. 1 (PRIOR ART)
FIG. 1 illustrates a developer supplying system in a liquid electrophotographic printer adopting a conventional pump.
Figure 2:
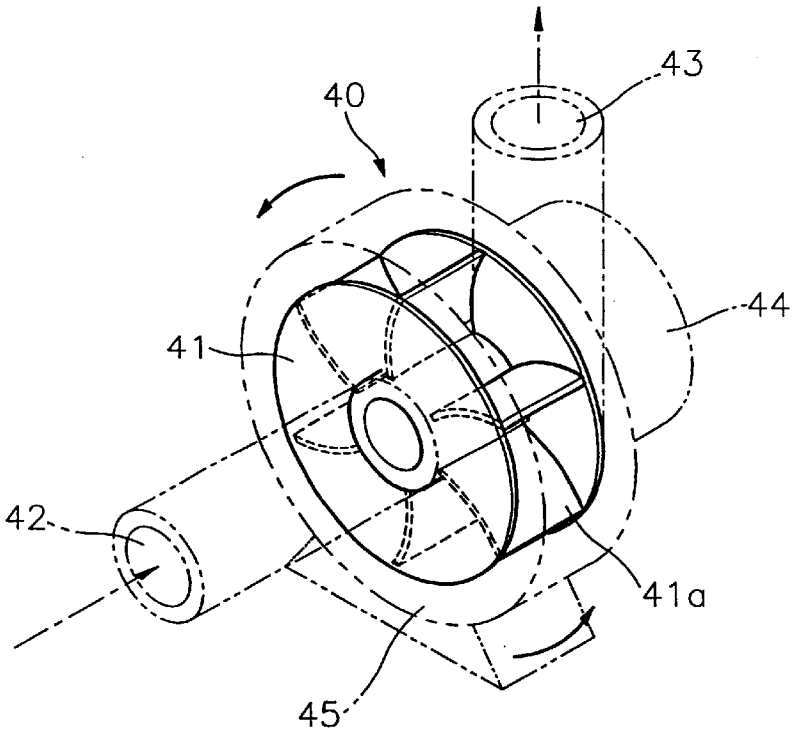
FIG. 2 (PRIOR ART)
FIGS. 2 and 3 schematically illustrate the internal structure of the conventional pump of FIG. 1.
Figure 3:
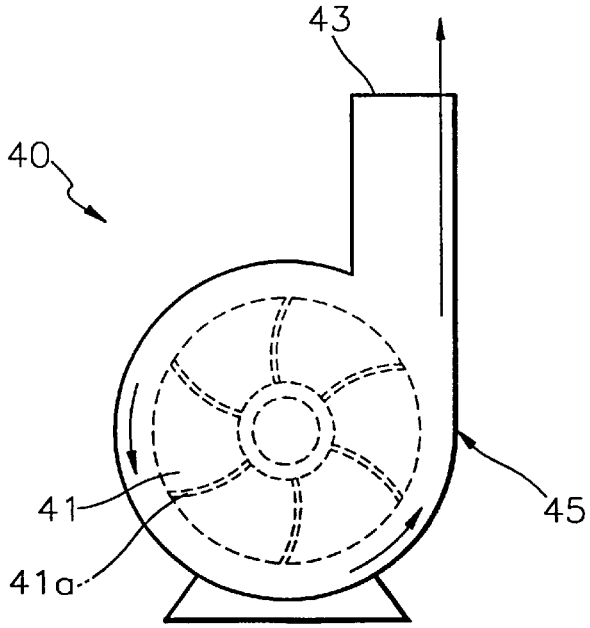
FIG. 3 (PRIOR ART)
Figure 7:
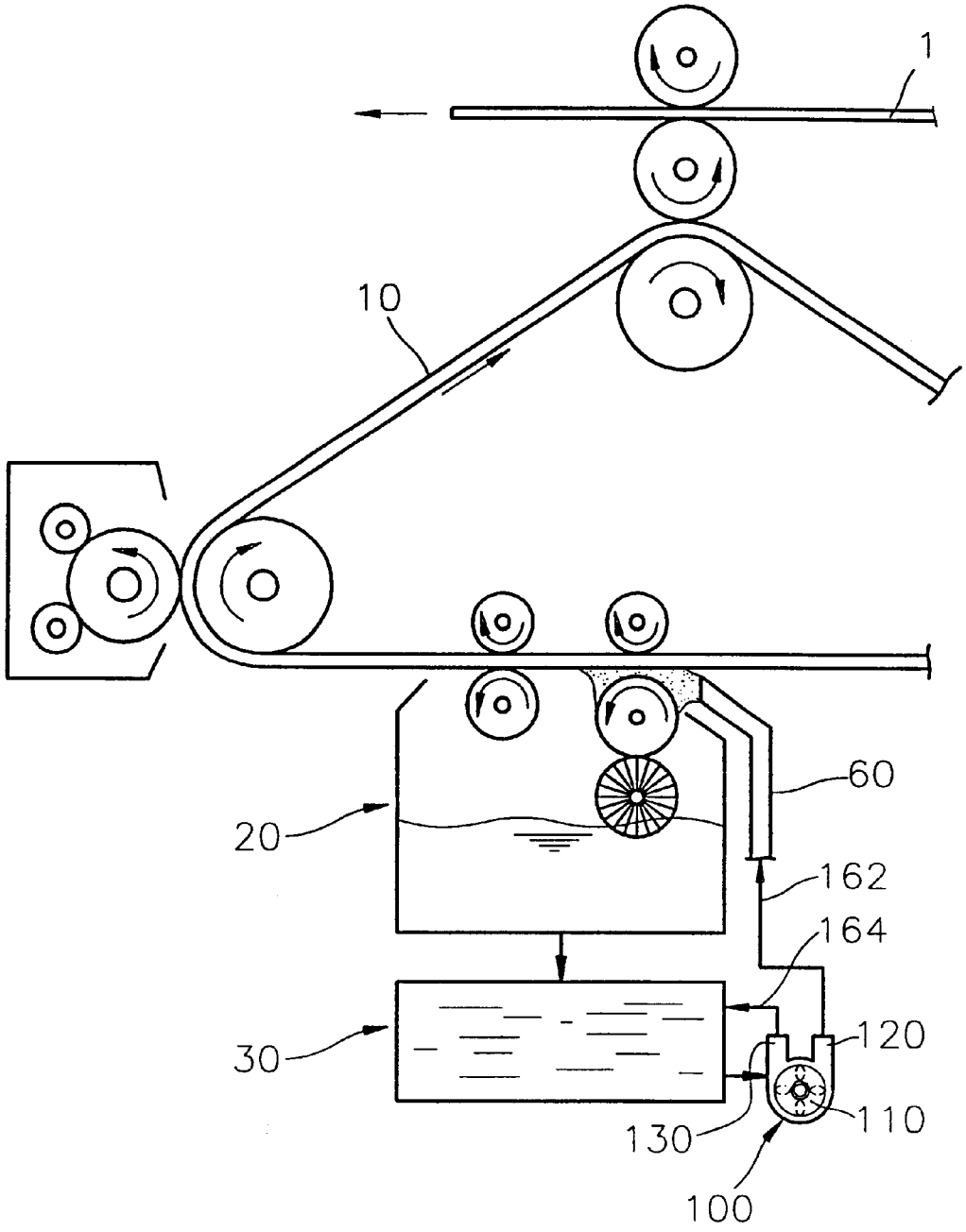
FIG. 7 schematically illustrates a developer supplying system in a liquid electrophotographic printer according to another embodiment of the present invention.

FIG. 7 schematically illustrates a developer supplying system in a liquid electrophotographic printer adopting the reversible pump 100. The same reference numerals as those in FIG. 1 denote the same elements.

As shown in FIG. 7, a path 162 for sending a developer to the developing unit 20 via the spray nozzle 60, and a path 164 for returning a developer to the developer tank 30 are connected respectively to the first and second outlets 120 and 130, so that the discharging direction of the developer can be selected according to the rotating direction of the impeller 110. That is, during the developing operation, the impeller 110 is rotated counterclockwise, and the developer is thus supplied to the developing unit 20 via the first outlet 120. While waiting to perform development, the impeller 110 is rotated clockwise, and the developer thus returns to the developer tank 30 via the second outlet 130.

As described above, the reversible pump according to the present invention is configured such that one of the discharging paths for fluid is selected according to the rotating direction of the impeller. Thus, when the reversible pump is adopted, particularly by the developer supplying system, a supply operation for spraying the developer and a return operation for agitating the interior of the developer tank can be performed without installing a special valve.

While preferred embodiments of the present invention have been described using specific terms, such description is for illustrative purposes only, and it is understood that changes and variations may be made by one skilled in the art without deviating from the broad principles and teachings of the present invention which shall be limited solely by the scope of the claims appended hereto.

What is claimed is:

1. A developer supply system in a liquid electrophotographic printer, for supplying a developer to a developing unit to develop a predetermined image on a photoreceptor belt, the system comprising:

a developer tank for containing the developer;

a spray nozzle for supplying the developer to the developing unit and photoreceptor belt therein; and a reversible pump including a case having an intake through which fluid is taken in from the developer tank, a first outlet for discharging the developer to the spray nozzle, and a second outlet for discharging the developer to the developer tank, an impeller rotatably installed within the case and which is capable of rotating in normal and reverse directions, the impeller having a plurality of blades the right and left sides of which are symmetrical to each other in the radial direction of the impeller so that the rotational loads in both the forward and reverse directions are substantially the same, and a motor for rotating the impeller.

* * * * *